US012723823B2

(12) United States Patent
Liao et al.

(10) Patent No.: US 12,723,823 B2
(45) Date of Patent: Sep. 1, 2026

(54) BLADE VAPOR CHAMBER STRUCTURE AND MANUFACTURING METHOD THEREOF

(71) Applicant: JWS TECHNOLOGY CO., LTD., New Taipei City (TV)

(72) Inventors: Pang-Hung Liao, New Taipei City (TW); Chih-Wei Chen, New Taipei City (TW); Chien-Chiang Kang, New Taipei City (TW); Ming-Chan Wu, New Taipei City (TW)

(73) Assignee: JWS TECHNOLOGY CO., LTD., New Taipei City (TW)

( * ) Notice: Subject to any disclaimer, the term of this patent is extended or adjusted under 35 U.S.C. 154(b) by 205 days.

(21) Appl. No.: 18/884,008

(22) Filed: Sep. 12, 2024

(65) Prior Publication Data

US 2026/0071825 A1 Mar. 12, 2026

(51) Int. Cl.
*F28D 15/04* (2006.01)

(52) U.S. Cl.
CPC ..... *F28D 15/04* (2013.01)

(58) Field of Classification Search
CPC ..... F28F 2275/06; F28F 1/32; F28D 15/0233; F28D 15/04; F28D 15/00; F28D 15/0283; F28D 15/046; F28D 15/0275; F16L 5/00; F16L 5/02; H01W 40/226; H01W 40/231; H05K 7/20; H05K 7/20239; H05K 7/20409; H05K 7/20463
See application file for complete search history.

(56) References Cited

U.S. PATENT DOCUMENTS

2017/0314870 A1 11/2017 Lin

FOREIGN PATENT DOCUMENTS

| | | | | |
|---|---|---|---|---|
| CN | 108151565 B | * | 12/2019 | ..... F28D 15/046 |
| TW | 201641911 A | | 12/2016 | |
| TW | M621682 U | | 1/2022 | |

OTHER PUBLICATIONS

Office Action dated Feb. 17, 2025 of the corresponding Taiwan patent application No. 113126403.

* cited by examiner

*Primary Examiner* — Harry E Arant
(74) *Attorney, Agent, or Firm* — HDLS IPR SERVICES; Chun-Ming Shih

(57) ABSTRACT

A blade vapor chamber structure and a manufacturing method thereof are disclosed. The blade vapor chamber structure includes a vapor chamber, a thermal conductive part and a seal ring module, the vapor chamber includes a casing with a through opening; the thermal conductive part is inserted in the through opening and has a peripheral wall; the seal ring module surrounds outside of the peripheral wall and seals the through opening, and includes two ring parts and solder layer, each ring part is formed by multiple blocks, a gap is formed between two adjacent blocks, the gaps of the ring part at the upper layer and the gaps of the ring part at the lower layer are misaligned, and a solder layer is filled between two adjacent ring parts, between the ring part at the lower layer and casing, between the peripheral wall and each ring part, and in each gap.

11 Claims, 12 Drawing Sheets

BLADE VAPOR CHAMBER STRUCTURE AND MANUFACTURING METHOD THEREOF

BACKGROUND OF THE DISCLOSURE

Technical Field

The present disclosure relates to a vapor chamber structure and a manufacturing method thereof, particularly relates to a blade vapor chamber structure and a manufacturing method thereof.

Description of Related Art

Currently, there is a type of blade vapor chamber in the market, and it refers to a vapor chamber vertically connected with another vapor chamber, a heat pipe or a thermal conductive plate to form a 3D structure of the vapor chamber. In particular, the vapor chamber is connected with the chamber inside another vapor chamber or a heat pipe, and the phase change of the working fluid is carried out through the connected chambers to improve the heat dissipation efficiency of the entire vapor chamber.

In the manufacturing method of a related-art vapor chamber which is vertically connected to another vapor chamber, a heat pipe or a thermal conductive plate, the vapor chamber casing is stamped to form a hollow ring first, and then another vapor chamber, heat pipe or thermal conductive plate is plugged into the hollow ring for positioning, and finally the vapor chamber is soldered along the hollow ring to connect the other vapor chamber, heat pipe or thermal conductive plate, so as to produce a blade vapor chamber.

However, the manufacturing method in which a vapor chamber, a heat pipe or a thermal conductive plate is vertically connected to the aforementioned vapor chamber has the following disadvantages. Firstly, the inner periphery and end edge of the hollow ring will be easily cracked during the stretching process of stamping molding, resulting in the lower yield of the subsequent soldering process; secondly, the corner end of the hollow ring is only made into a round corner (R corner) because of the stamping molding and unable to be made into a right angle or fitted together. As a result, there will be a bigger gap that will lower the yield rate of the subsequent soldering and sealing processes.

In view of the deficiencies of the related art, the present discloser conducted researches based on the existing technologies and the application of theories, and finally developed a blade vapor chamber in accordance with the present disclosure to overcome the deficiencies of the related art.

SUMMARY OF THE DISCLOSURE

The disclosure provides a blade vapor chamber structure and a manufacturing method thereof, which use the plurality of gaps of the ring part at the upper layer and the plurality of gaps of the ring part at the lower layer being misaligned with each other, and the solder layer being filled into each gap, to achieve desirable soldering airtightness of the blade vapor chamber structure.

In some embodiments, the present disclosure provides a blade vapor chamber structure, including: a vapor chamber, having a casing, the casing having a through opening defined on the casing; a thermal conductive part, inserted in the through opening, the thermal conductive part having a peripheral wall exposed from the through opening; and a seal ring module, tightly surrounding the peripheral wall and sealing the through opening, and including at least two ring parts perpendicularly stacked and a solder layer, each ring part including a plurality of blocks connected to each other to be a ring, wherein a gap is defined between every two blocks adjacent to each other, a plurality of gaps of the ring part at an upper layer and a plurality of gaps of the ring part at a lower layer is misaligned with each other, and the solder layer is filled between two ring parts adjacent to each other, filled between the ring part at the lower layer and the casing, filled between the peripheral wall and each ring part, and filled in each gap.

In some embodiments, the present disclosure provides a blade vapor chamber structure manufacturing method, including the steps of: (A) providing a vapor chamber which includes a casing with a through opening; (B) providing a thermal conductive part, and plugging the thermal conductive part into the through opening, wherein the thermal conductive part has a peripheral wall exposed from the through opening; (C) providing at least two ring parts and a solder, perpendicularly stacking the at least two ring parts around the peripheral wall and sealing the through opening, and sandwiching the solder between two ring parts adjacent to each other and the ring part at the lower layer and the casing, wherein each ring part is formed and enclosed by a plurality of blocks, a gap is formed between two blocks adjacent to each other, the plurality of gaps of the ring part at the upper layer and the plurality of gaps of the ring part at the lower layer are misaligned with each other; and (D) performing a heating operation of the solder, such that the solder is molten to form a solder layer filled between two ring parts adjacent to each other, and disposed between the ring part at the lower layer and the casing, between the peripheral wall and each ring part, and in each gap.

Based on the above, the related art uses a vapor chamber to stamp out the hollow ring, and then tightly surrounds the hollow ring around the thermal conductive part, but the hollow ring is prone to have surface cracking occurred due to the stretching during the stamping process, and the corner end of the hollow ring may only be made into a round corner (R corner) due to the stamping formation and may not closely fit the right-angled thermal conductive part. As a result, there will be a large gap between the round corner of the hollow ring and the right-angled thermal conductive part, which will lower the subsequent soldering airtightness. In comparison, the outer casing of the present disclosure is in the shape of a right angle, each block is not stamped and formed from the casing, the outer casing and the casing are two separate components, the block may be easily formed in the shape of a right angle through the manufacturing process such as mold injection molding or lathe processing. The right-angled blocks combined with the right-angle thermal conductive part makes the gap smaller to avoid surface cracking and achieves the effect of wrapping and fitting the plurality of blocks of each ring part around the thermal conductive part more tightly, thereby improving the soldering airtightness of the blade vapor chamber structure.

Since the plurality of gaps of the ring part at the upper layer and the plurality of gaps of the ring part at the lower layer are misaligned with each other, so that each gap is sealed by filling the solder layer, or the upper and lower ends of each gap may be sealed by blocking the block or the casing on the upper and lower sides, so as to further improve the soldering airtightness of the blade vapor chamber structure, make the plurality of gaps to be misaligned and non-communicated with each other, and seal and combine the solder layer between different layers to achieve the airtight effect.

DETAILED DESCRIPTION

The detailed description and technical contents of the present disclosure are illustrated with reference to the accompanying drawings, which are intended for the illustrative purposes only, but not intended for limiting the disclosure.

With reference to FIGS. 1 to 11, the present disclosure provides a blade vapor chamber structure and a manufacturing method thereof, the blade vapor chamber structure 10 mainly includes a vapor chamber 1, one or more thermal conductive parts 2 and one or more seal ring modules 3.

Figure 1:
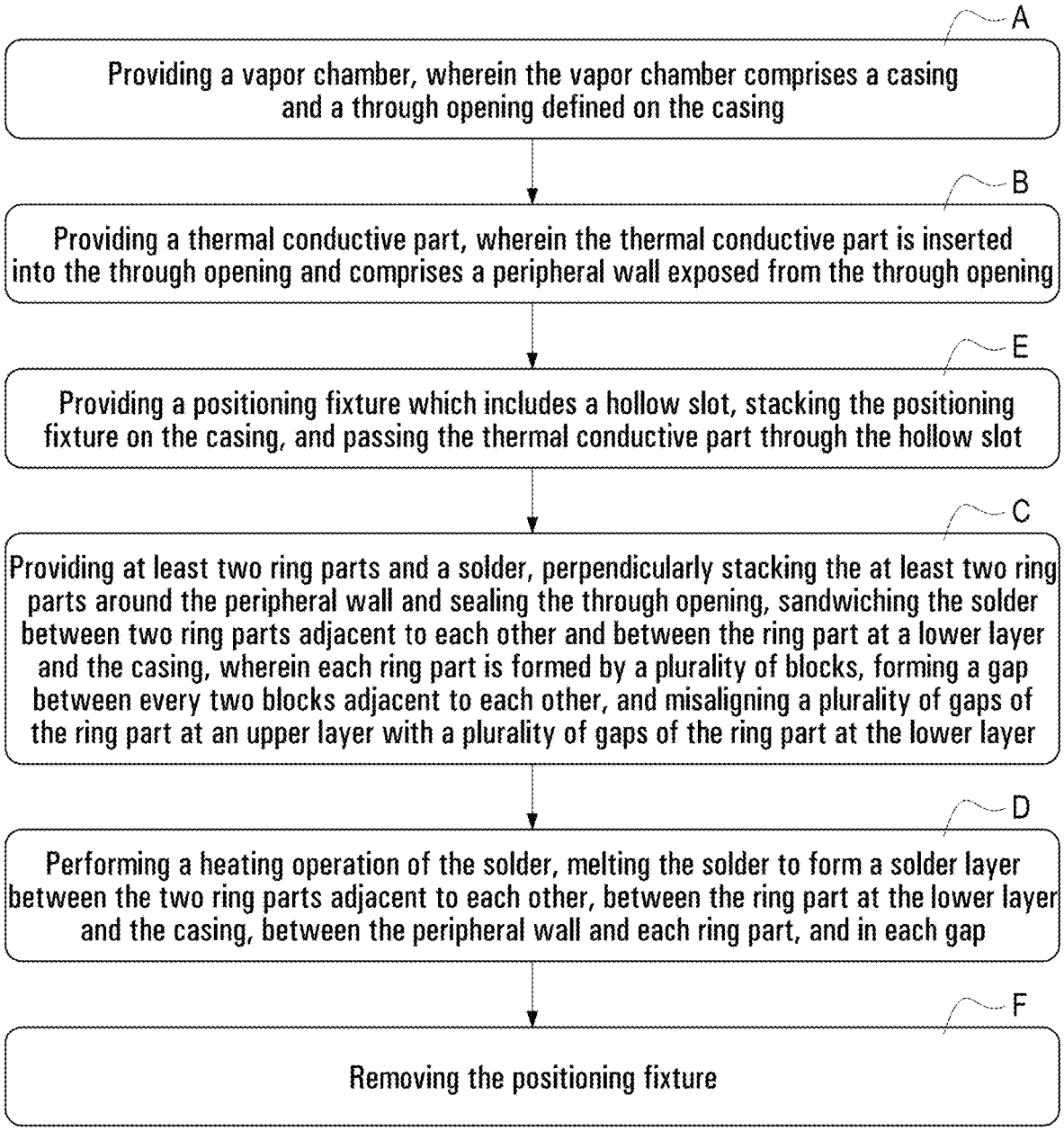
FIG. 1 is a flow chart of the blade vapor chamber structure manufacturing method of the disclosure.
Figure 2:
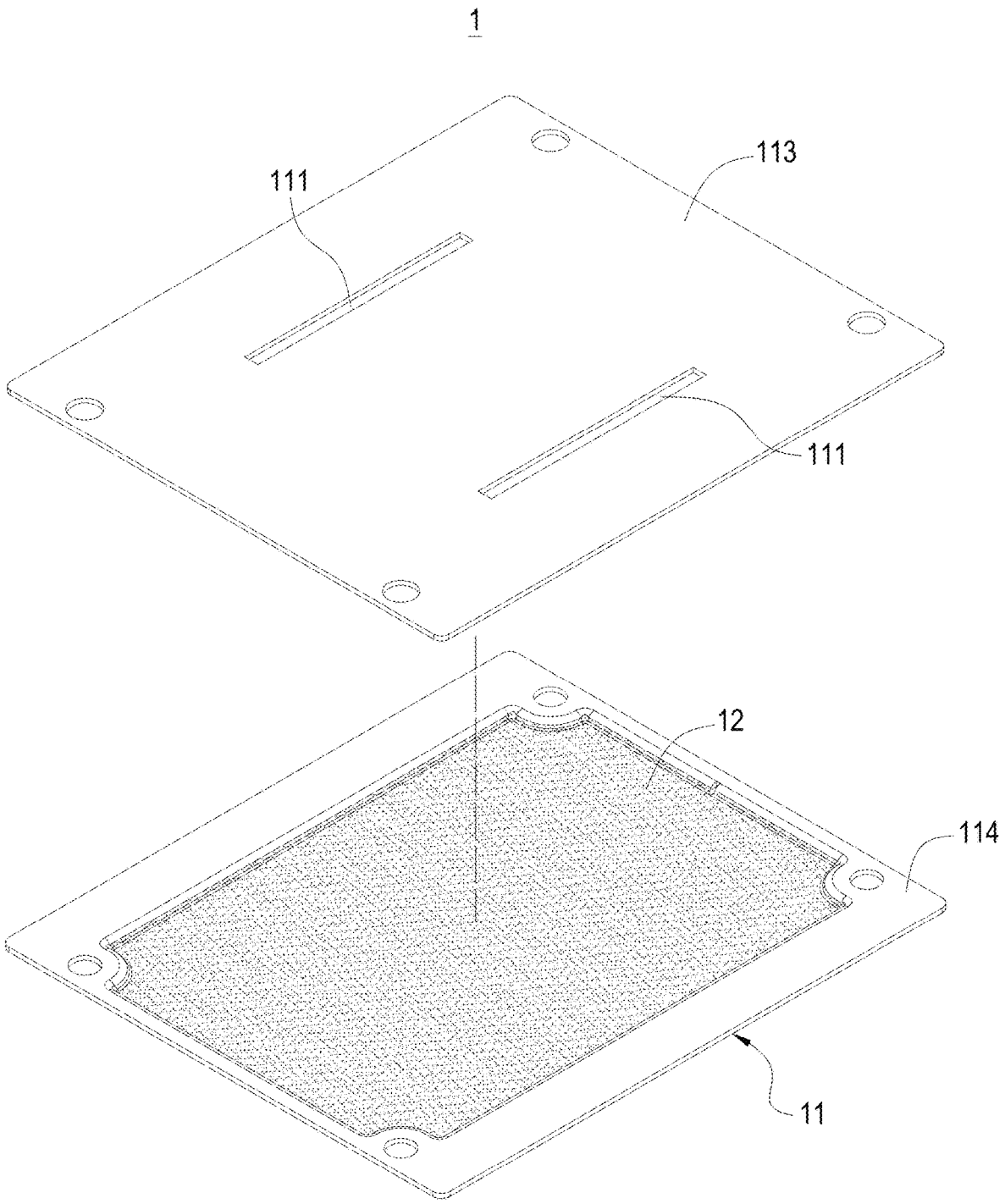
FIG. 2 is a disassembled diagram of the vapor chamber of the disclosure.

As shown in FIG. 1, the steps of the manufacturing method of a blade vapor chamber structure 10 of the present disclosure are described in details below. First, ss shown in the Step (A) of FIG. 1 and FIGS. 2 and 3, a vapor chamber 1 is provided. The vapor chamber 1 includes a casing 11 with one or more through openings 111. There are two through openings 111 in this embodiment, but the disclosure is not limited to such arrangement.

In addition, the casing 11 includes a top panel 113 and a base 114 soldered and connected to each other, the top panel 113 and the base 114 are opposite to each other, and the through opening 111 is formed from the top panel 113 by stamping, laser cutting or other manufacturing processes.

Figure 3:
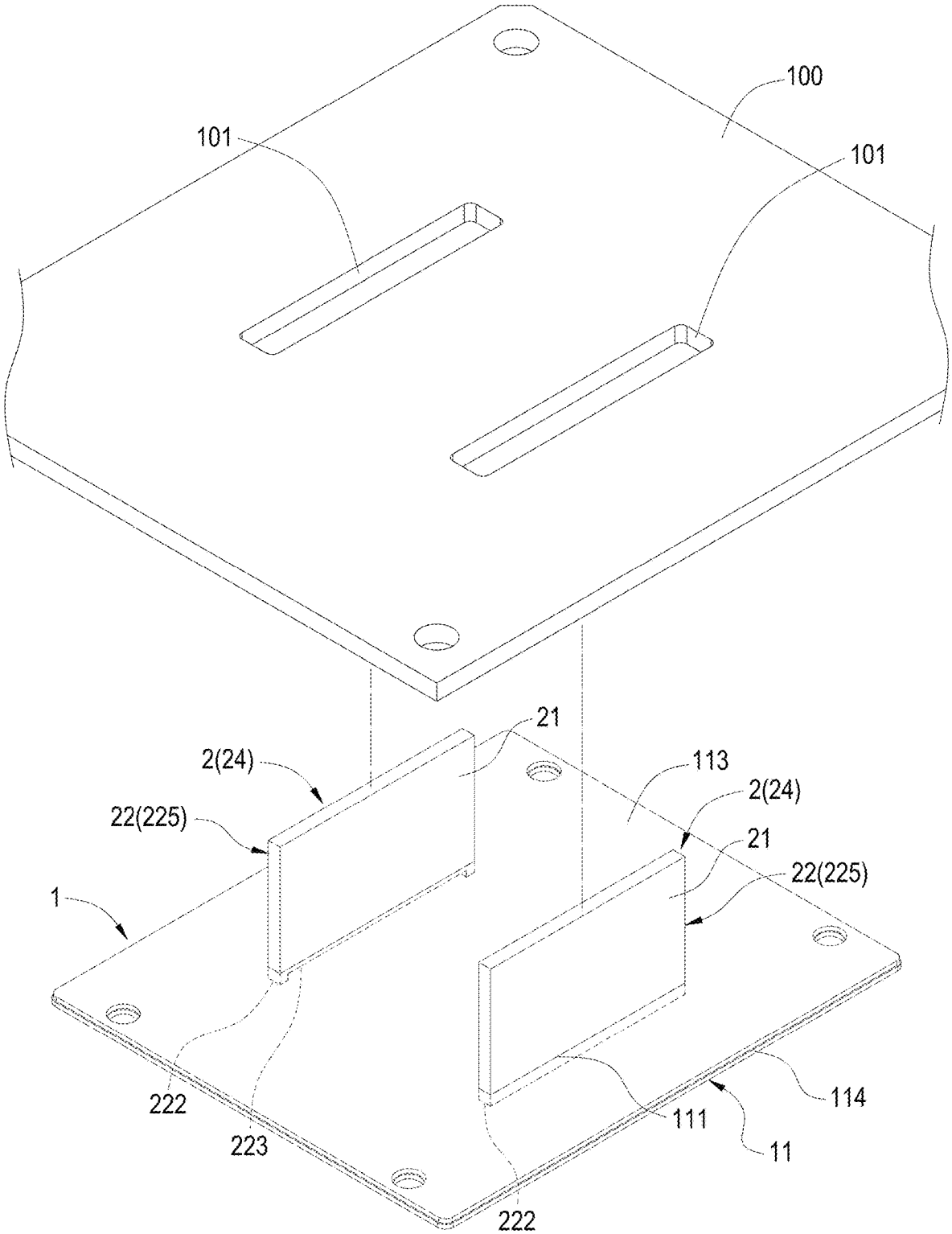
FIG. 3 is a schematic diagram of the thermal conductive part plugged into the through opening of the disclosure.
Figure 4:
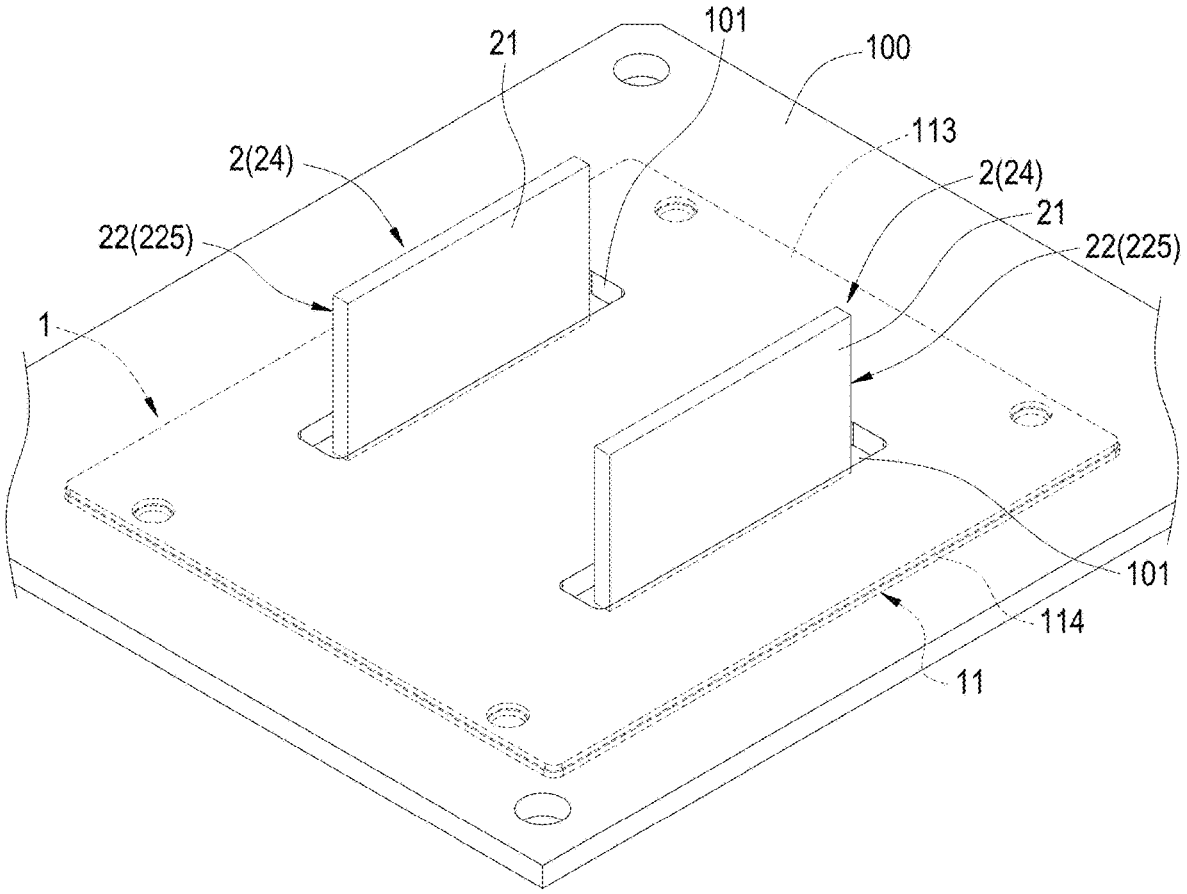
FIG. 4 is a schematic diagram of the positioning fixture stacked on the casing of the disclosure.
Figure 5:
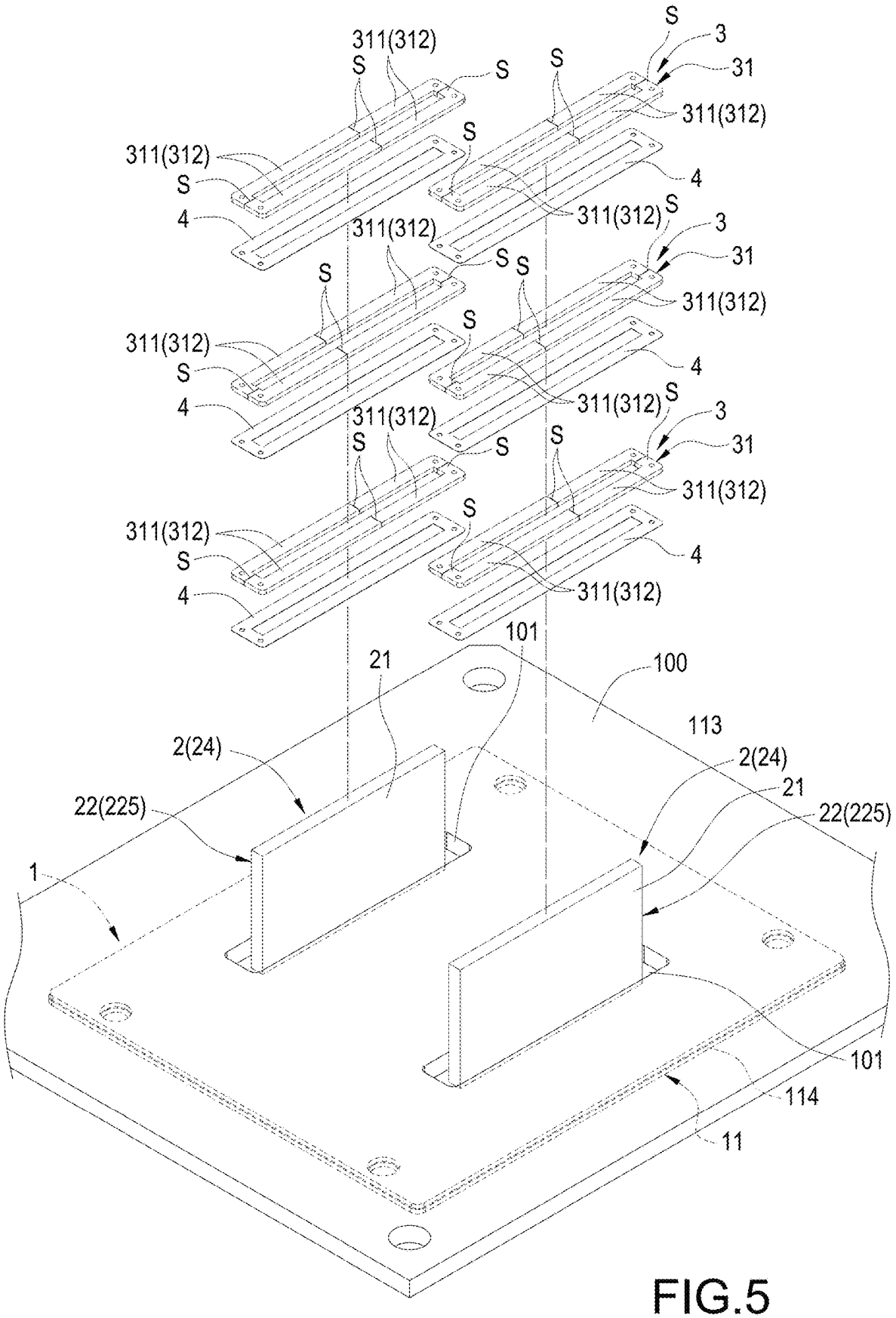
FIG. 5 is a schematic diagram of the plurality of ring parts to be vertically stacked around the peripheral wall of the disclosure.
Figure 6:
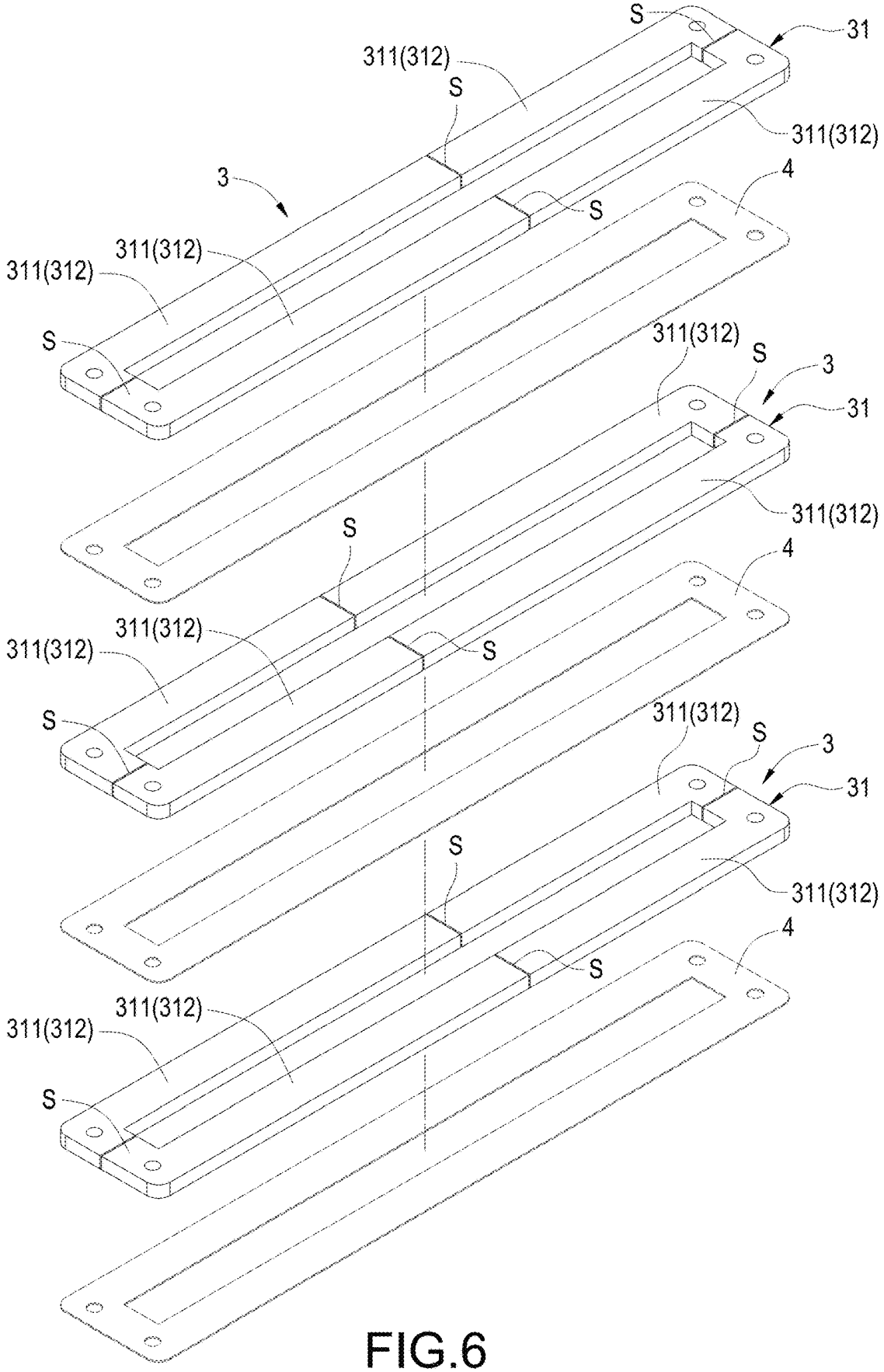
FIG. 6 is a schematic diagram of the plurality of ring parts to be vertically stacked of the disclosure.
Figure 7:
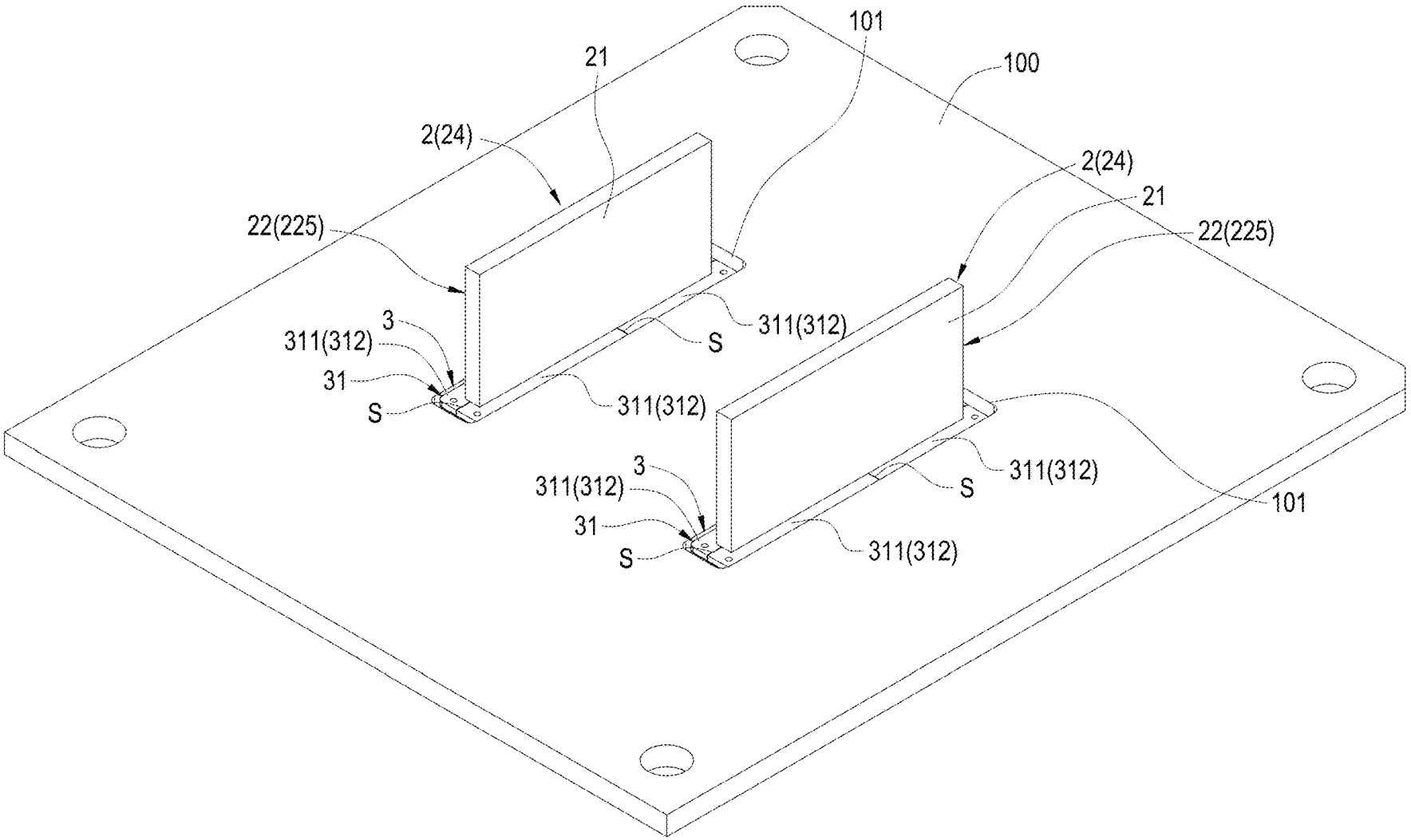
FIG. 7 is a schematic diagram of the plurality of ring parts already vertically stacked around the peripheral wall of the disclosure.

Second, as shown the Step (B) of FIG. 1, and FIGS. 3 and 4, one or more thermal conductive parts 2 are provided and inserted into the through opening 111, and the thermal conductive part 2 has a peripheral wall 21 exposed from the through opening 111. In this embodiment, there are two thermal conductive parts 2, but the disclosure is not limited to such arrangement.

Third, as shown in the Step (E) of FIG. 1 and FIG. 4, the Step (E) takes place between the Step (B) and the Step (C), a positioning fixture 100 is provided. The positioning fixture 100 includes one or more hollow slots 101, the positioning fixture 100 is stacked on the casing 11, and the thermal conductive part 2 passes through the hollow slot 101. In this embodiment, there are two hollow slots 101, but the disclosure is not limited to such arrangement.

Fourth, as shown in the Step (C) of FIG. 1, and FIGS. 5 to 7, at least two ring parts 31 and a solder are provided, the at least two ring parts 31 and the solder are placed into the hollow slot 101, and the positioning fixture 100 is provided for vertically stacking the at least two ring parts 31 around he peripheral wall 21 and sealing the through opening 111, the solder is sandwiched between two ring parts 31 adjacent to each other and disposed between the ring part 31 at the lower layer and the casing 11, each ring part 31 is formed and enclosed by a plurality of blocks 311, a gap S is formed between two blocks 311 adjacent to each other, and the plurality of gaps S of the ring part 31 at the upper layer and the plurality of gaps S of the ring part 31 at the lower layer are misaligned with each other. In this embodiment, there are six ring parts 31, three of them are stacked with each other into a group, and the other three are stacked with each other into another group, and the solder is a solder sheet 4, but the disclosure is not limited to such arrangements. Each block 311 is manufactured into the shape of a right angle by mold injection molding or lathe processing.

Fifth, as shown in the Step (D) of FIG. 1 and FIGS. 7 to 9, a heating operation of the solder is performed, so that the solder is molten to form a solder layer 32 which is filled between two ring parts 31 adjacent to each other, between the ring part 31 at the lower layer and the casing 11, between the peripheral wall 21 and each ring part 31, and in each gap S. In other words, the solder layer 32 is formed by melting the solder and sandwiched between two ring parts 31 adjacent to each other and disposed between the ring part 31 at the lower layer and the casing 11.

Further, in the heating operation the vapor chamber 1, the thermal conductive part 2, the at least two ring parts 31, and the solder and positioning fixture 100 are jointly fed into a heating oven, the solder is one or more solder sheets 4 or solder paste, the solder sheet 4 or solder paste is heated to a molten state, the molten solder sheet 4 or solder paste will penetrate between the peripheral wall 21 and each ring part 31 and into each gap S, and then the molten solder sheet 4 or solder paste will be cooled to form the solder layer 32.

Figure 10:
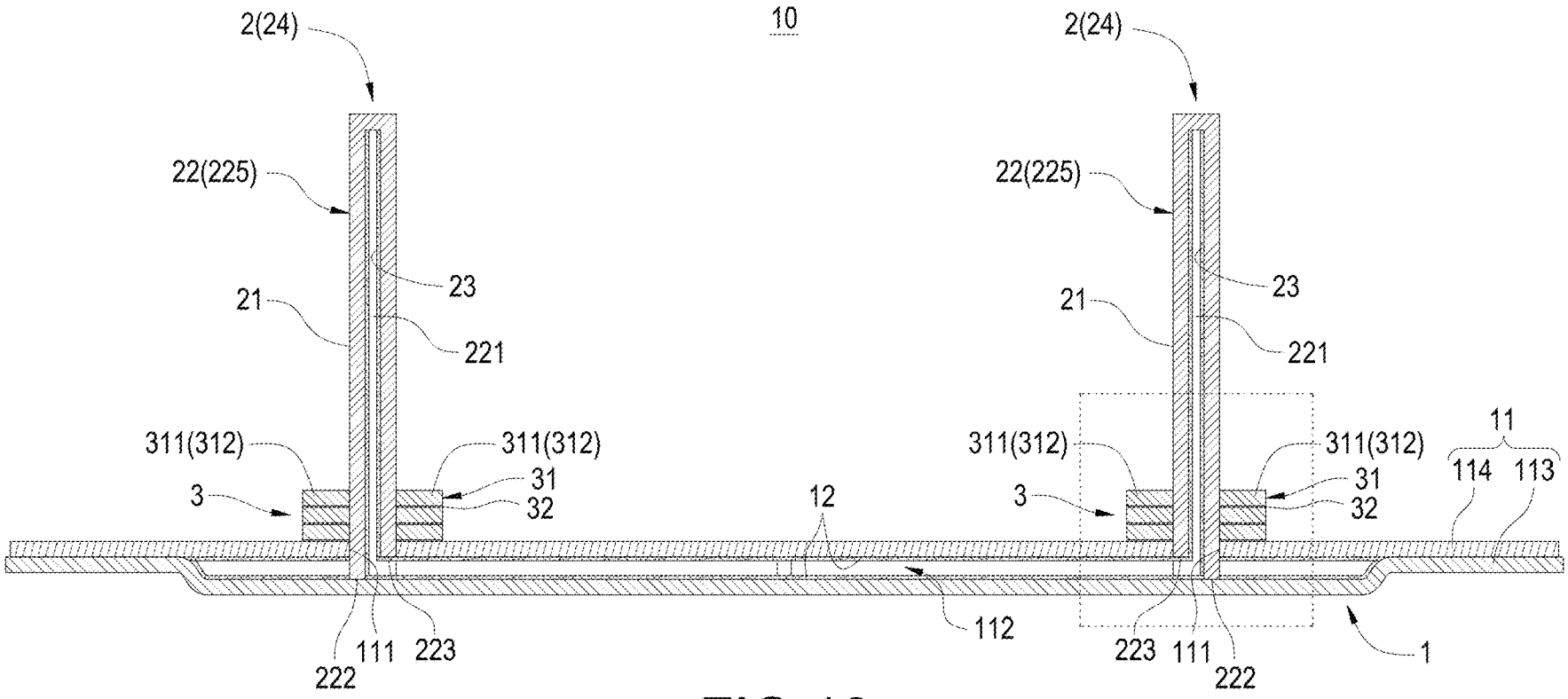
FIG. 10 is a cross-sectional diagram of the blade vapor chamber structure of the disclosure.
Figure 11:
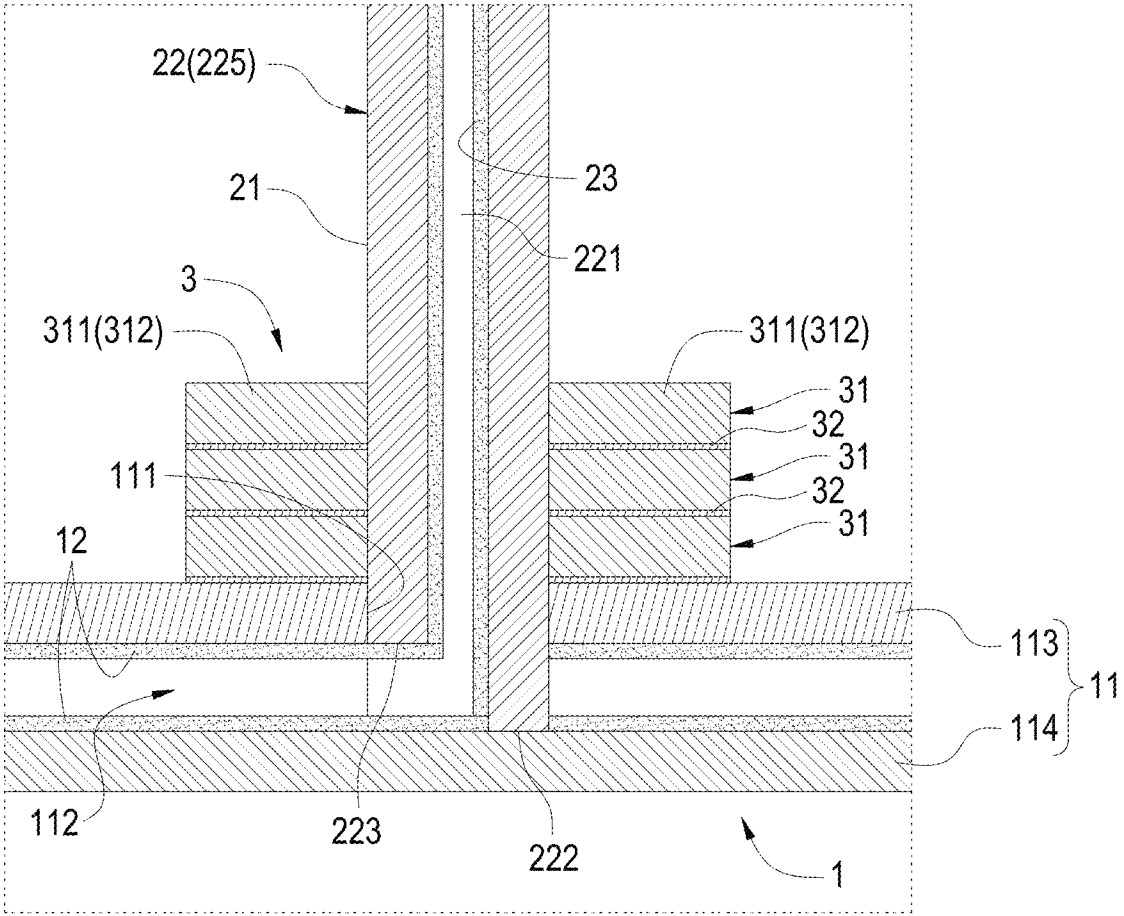
FIG. 11 is an enlarged diagram of the section of the dotted frame in FIG. 10.

In FIGS. 10 and 11, a first chamber 112 is formed inside the casing 11, the thermal conductive part 2 includes an outer casing 22 inserted into the through opening 111, the peripheral wall 21 is formed at the outer periphery of the outer casing 22, the inside of the outer casing 22 is formed with a second chamber 221 which communicates with the first chamber 112, a seal ring module 3 is formed by the at least ring parts 31 perpendicularly stacked and the solder layer 32 and tightly surrounds the peripheral wall 21 and seals the through opening 111, and at the same time seals the first chamber 112 and the second chamber 221.

In FIGS. 10 and 11, the vapor chamber 1 further includes a first capillary structure 12 covering the inside of the casing 11, an end of the outer casing 22 is provided with an open end 222 abutting the base 114, the open end 222 is provided with a communicating opening 223 that communicates with the first chamber 112 and the second chamber 221, an inner edge of the communicating opening 223 is opposite to the top panel 113, the thermal conductive part 2 further includes a second capillary structure 23 covering the inside of the outer casing 22 and the inner edge of the communicating opening 223, and covering the adjacent open end 222, and the second capillary structure 23 and the first capillary structure 12 at the inner edge of the communicating opening 223 are in contact with each other.

In addition, the blade vapor chamber structure 10 of the present disclosure further includes a working fluid (not shown in the figures) filled in the first chamber 112 and the second chamber 221, the vapor chamber 1 is used to be thermally attached to a heat generating element (not shown in the figures), so that the liquid-state working fluid in the first chamber 112 absorbs the heat generated from the heat generating element to become a gaseous working fluid, the gaseous working fluid flows through the open end 222 from the first chamber 112 into the second chamber 221, the gaseous working fluid transmits the heat to the outer casing 22 of the thermal conductive part 2 and is condensed to become the liquid-state working fluid, and finally, the liquid-state working fluid reflows through the second capillary structure 23 back to the first capillary structure 12 to achieve the effect that the working fluid sequentially passes through the first chamber 112, the second chamber 221, the second capillary structure 23 and the first capillary structure 12 to perform a cycle of phase change, heat absorption and heat dissipation.

In addition, the thermal conductive part 2 of this embodiment is a vertical vapor chamber 24, the outer casing 22 is a plate casing 225, the through opening 111 is in a long rectangular shape, the plurality of blocks 311 of each ring part 31 is four L-shaped blocks 312 surrounding the plate casing 225, but the disclosure is not limited to such arrangement, and the thermal conductive part 2 may be a thermal conductive plate (not shown in the figures) plugged into a long rectangular through opening 111, the plurality of blocks 311 of each ring part 31 may also be four L-shaped blocks 312 surrounding the thermal conductive plate.

Figure 8:
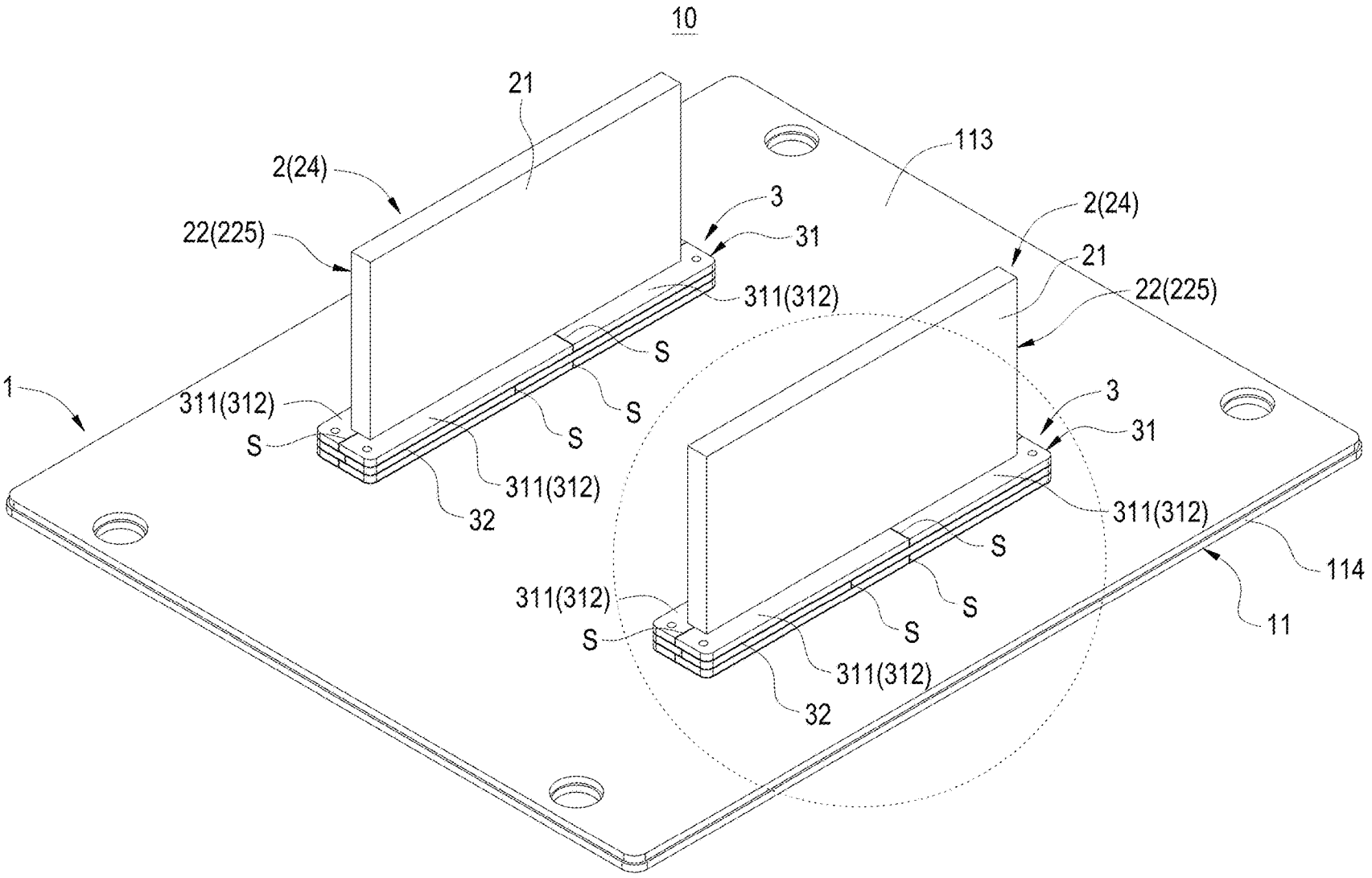
FIG. 8 is a perspective assembled diagram of the blade vapor chamber structure of the disclosure.
Figure 9:
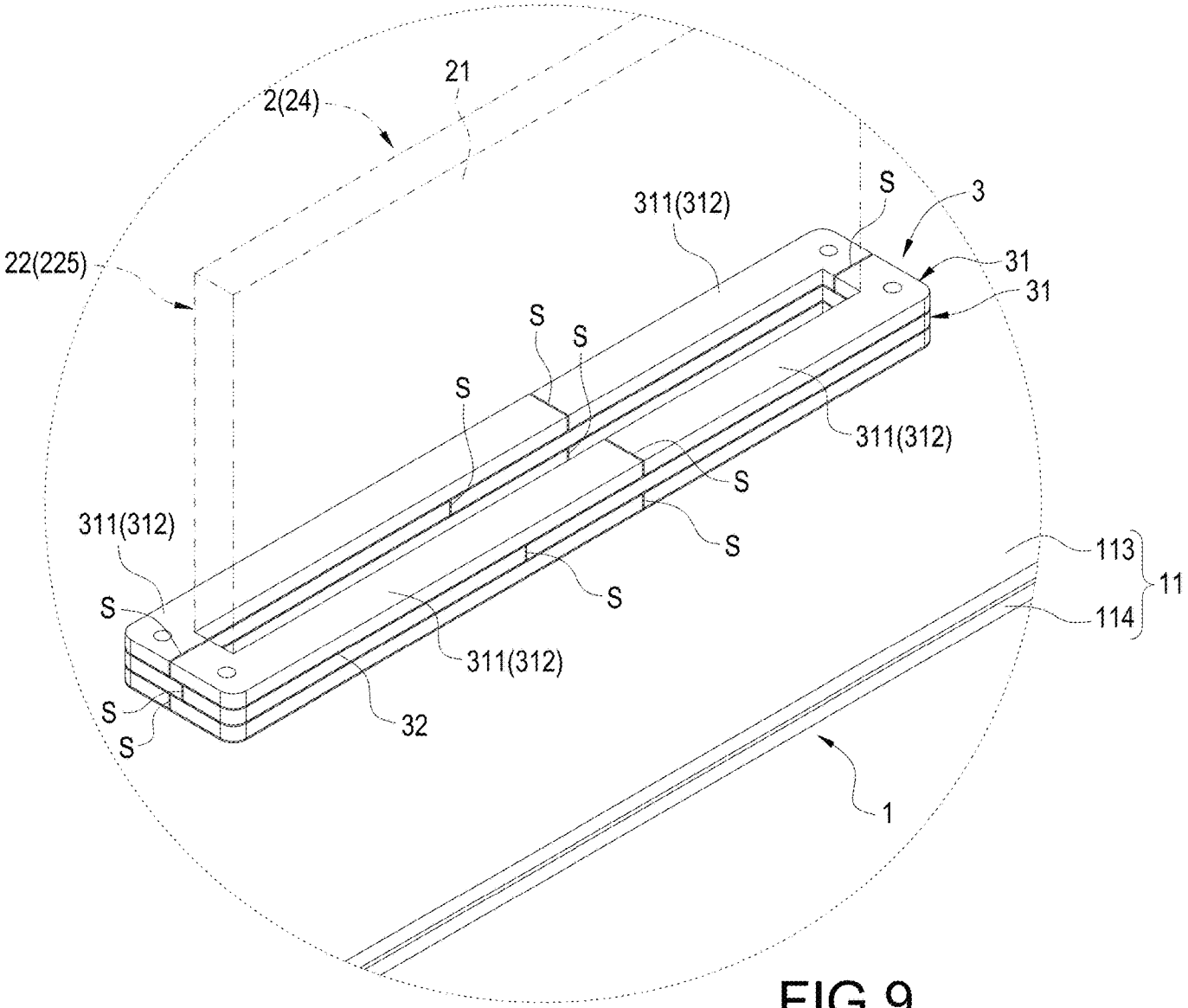
FIG. 9 is an enlarged diagram of the section of the dotted circle in FIG. 8.

Sixth, as shown in the Step (F) of FIG. 1 and FIGS. 8 and 9, finally, the positioning fixture 100 is removed from the casing 11, the top of the vapor chamber 1 is combined with the thermal conductive part 2 in to a blade shape through the through opening 111 and seal ring module 3 to produce the product with the blade vapor chamber structure 10.

With reference to FIGS. 5 to 11 for the using status of the blade vapor chamber structure 10 of the present disclosure, the seal ring module 3 is provided and tightly surrounds around the peripheral wall 21 and seals the through opening 111, the seal ring module 3 includes at least two ring parts 31 perpendicularly stacked and a solder layer 32, each ring part 31 is formed and enclosed by the plurality of blocks 311, a gap S is formed between two blocks 311 adjacent to each other, the plurality of gaps S of the ring part 31 at the upper layer and the plurality of gaps S of the ring part 31 at the lower layer are misaligned with each other, the solder layer 32 is filled between two ring parts 31 adjacent to each other, and disposed between the ring part 31 at the at the lower layer and the casing 11, between the peripheral wall 21 and each ring part 31 and in each gap S, so that the thermal conductive part 2 is secured onto the vapor chamber 1.

In this way, the related art uses the vapor chamber to stamp out a hollow ring, and then the hollow ring tightly surrounds around the thermal conductive part, but the hollow ring is prone to have surface cracking occurred due to the stretching during the stamping process, and the corner end of the hollow ring may only be made into a round corner (R corner) due to the stamping formation and may not closely fit the right-angled thermal conductive part. As a result, there will be a large gap between the round corner of the hollow ring and the right-angled thermal conductive part, which will lower the subsequent soldering airtightness. In comparison, the outer casing 22 of the present disclosure is in the shape of a right angle, each block 311 is not stamped and formed from the casing, the outer casing 22 and the casing 11 are two separate components, the block 311 may be easily formed in the shape of a right angle through the manufacturing process such as mold injection molding or lathe processing. The right-angled blocks 311 combined with the right-angle thermal conductive part 2 makes the gap smaller to avoid surface cracking and achieves the effect of wrapping and fitting the plurality of blocks 311 of each ring part 31 around the thermal conductive part 2 more tightly, thereby improving the soldering airtightness of the blade vapor chamber structure 10.

Since the plurality of gaps S of the ring part 31 at the upper layer and the plurality of gaps S of the ring part 31 at the lower layer are misaligned with each other, therefore each gap S is sealed by filling the solder layer 32, or the upper and lower ends of each gap S is sealed by blocking the block 311 or the casing 11 on the upper and lower sides, so as to further enhance the soldering airtightness of the blade vapor chamber structure 10 and make the positions of the plurality of gaps S to be misaligned with each other and not communicated with each other, and the sealing effect of the solder layer 32 between different layers may be used to achieve the airtight effect.

Figure 12:
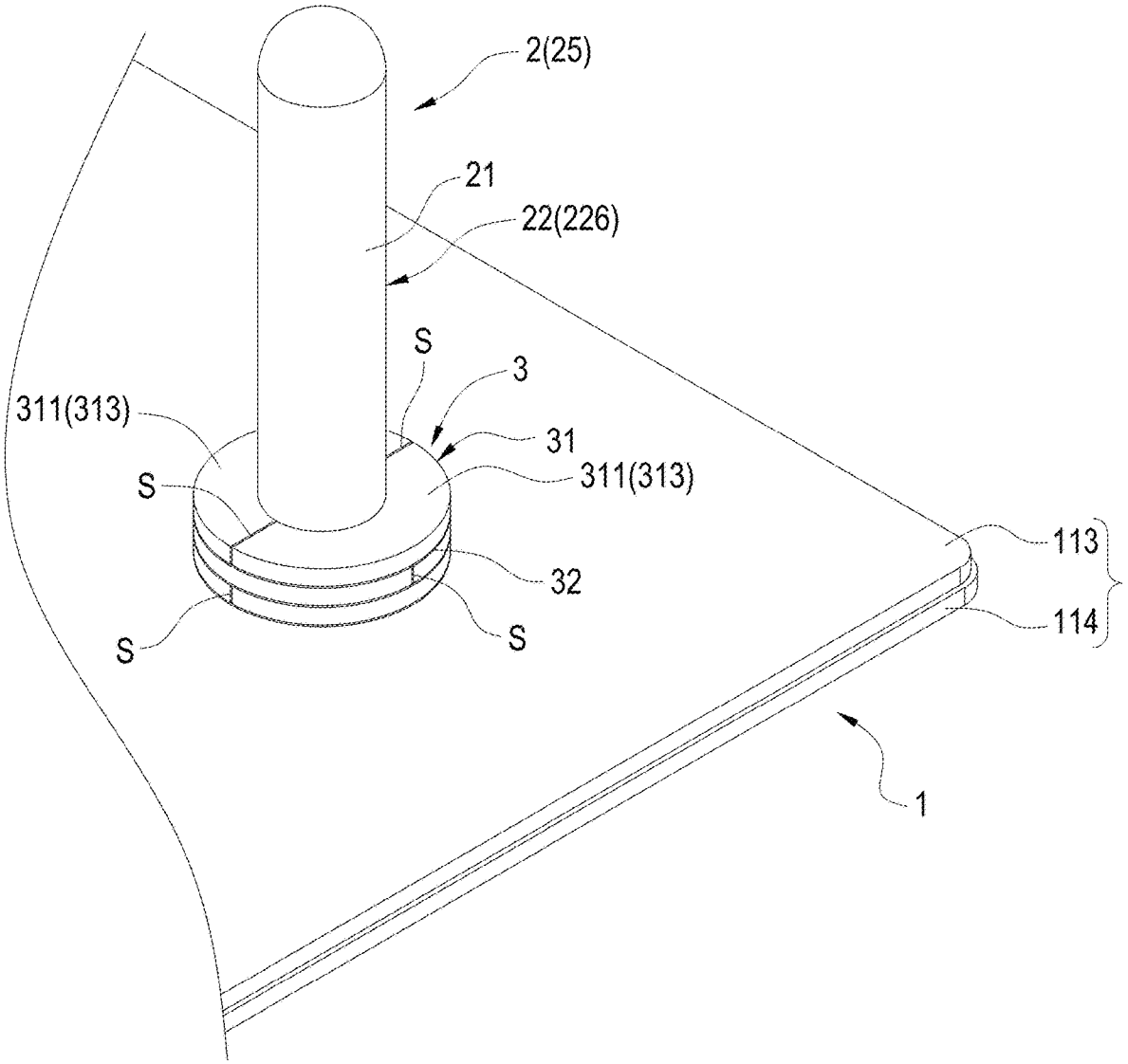
FIG. 12 is a partially enlarged diagram of the blade vapor chamber of another embodiment of the disclosure.

With reference to FIG. 12 for another embodiment of the blade vapor chamber structure 10 of the present disclosure, the embodiment of FIG. 12 is substantially the same as the embodiment as shown in FIGS. 1 to 11, except that the thermal conductive part 2 of this embodiment is a heat pipe 25.

The detailed description is as follows. The thermal conductive part 2 of this embodiment is a heat pipe 25, the outer casing 22 is a tube body 226, the through opening 111 is in a circular or oval shape, the plurality of blocks 311 of each ring part 31 is four arc blocks 313 surrounding the tube body 226, but the disclosure is not limited to such arrangement.

By replacing the vertical vapor chamber 24 of the embodiment as shown in FIGS. 1 to 11 with the heat pipe 25, the working fluid may also flow through the open end 222 into the first chamber 112 and the second chamber 221 to carry out a phase change heat dissipation through the first capillary structure 12 and the second capillary structure 23. Since the plurality of gaps S of the ring part 31 at the upper layer and the plurality of gaps S of the ring part 31 at the lower layer are misaligned with each other, therefore each gap S is sealed by filling the solder layer 32, the upper and lower ends of each gap S is also sealed by blocking the block 311 or the casing 11 on the upper and lower sides in order to achieve the same function and effect of the embodiment in FIGS. 1 to 11.

While this disclosure has been described by means of specific embodiments, numerous modifications and variations may be made thereto by those skilled in the art without departing from the scope and spirit of this disclosure set forth in the claims.

What is claimed is:

1. A blade vapor chamber structure, comprising:

a vapor chamber, comprising a casing, the casing comprising a through opening defined thereon;

a thermal conductive part, inserted in the through opening, and comprising a peripheral wall exposed from the through opening; and a seal ring module, tightly surrounding the peripheral wall and sealing the through opening, and comprising at least two ring parts perpendicularly stacked and a solder layer, each ring part comprising a plurality of blocks connected to each other to be a ring, wherein a gap is defined between every two blocks adjacent to each other, a plurality of gaps of the ring part at a upper layer and a plurality of gaps of the ring part at a lower layer is misaligned with each other, and the solder layer is filled between two ring parts adjacent to each other, filled between the ring part at the lower layer and the casing, filled between the peripheral wall and each ring part, and filled in each gap.

2. The blade vapor chamber structure according to claim 1, further comprising a working fluid, the casing comprising a first chamber defined therein, the thermal conductive part comprising an outer casing inserted in the through opening, the outer casing comprising a second chamber defined therein and communicating with the first chamber, the working fluid filled in the first chamber and the second chamber, and the peripheral wall is an outer periphery of the outer casing.

3. The blade vapor chamber structure according to claim 2, wherein the vapor chamber further comprises a first capillary structure covering inside of the casing, the casing comprises a top panel and a base opposite to each other, the through opening is defined on the top panel, the outer casing comprises an open end disposed on an end thereof and abutting the base, the open end comprises a communicating opening communicating with the first chamber and the second chamber, inner edge of the communicating opening and the top panel are opposite to each other, the thermal conductive part further comprises a second capillary structure covering inside of the outer casing and inner edge of the communicating opening.

4. The blade vapor chamber structure according to claim 2, wherein the thermal conductive part is a vertical vapor chamber, the outer casing is a plate casing, the through opening is in a long rectangular shape, and the plurality of blocks of each ring part is four L-shaped blocks surrounding outside of the plate casing.

5. The blade vapor chamber structure according to claim 2, wherein the thermal conductive part is a heat pipe, the outer casing is a tube body, the through opening is in a circular or oval shape, and the plurality of blocks of each ring part is at least two arc blocks surrounding outside of the tube body.

6. The blade vapor chamber structure according to claim 1, wherein the solder layer is formed by melting the solder sandwiched between two adjacent ring parts and disposed between the ring part at the lower layer and the casing, and the solder is at least a solder sheet or a solder paste.

7. A blade vapor chamber structure manufacturing method, comprising:

(A) providing a vapor chamber, wherein the vapor chamber comprises a casing and a through opening defined on the casing;

(B) providing a thermal conductive part, wherein the thermal conductive part is inserted into the through opening and comprises a peripheral wall exposed from the through opening;

(C) providing at least two ring parts and a solder, perpendicularly stacking the at least two ring parts around the peripheral wall and sealing the through opening, sandwiching the solder between two ring parts adjacent to each other and between the ring part at a lower layer and the casing, wherein each ring part is formed by a plurality of blocks, forming a gap between every two blocks adjacent to each other, and misaligning a plurality of gaps of the ring part at an upper layer with a plurality of gaps of the ring part at the lower layer; and (D) performing a heating operation of the solder, melting the solder to form a solder layer between the two ring parts adjacent to each other, between the ring part at the lower layer and the casing, and between the peripheral wall and each ring part, and in each gap.

8. The blade vapor chamber structure manufacturing method according to claim 7, wherein in the (A), the casing comprises a top panel and a base soldered and coupled to each other, and the through opening is formed from the top panel by stamping and punching or laser cutting; in the (C), each block is formed by mold injection molding or lathe processing.

9. The blade vapor chamber structure manufacturing method according to claim 7, further comprising (E) between the (B) and (C), and (F) after the (D), in the (E) providing a positioning fixture with a hollow slot, stacking the positioning fixture on the casing, and passing the thermal conductive part through the hollow slot; and in the (F) removing the positioning fixture.

10. The blade vapor chamber structure manufacturing method according to claim 9, wherein in the (C), placing the at least two ring parts and the solder into the hollow slot to perpendicularly stacks the at least two ring parts around outside of the peripheral wall and seals the through opening through the positioning fixture.

11. The blade vapor chamber structure manufacturing method according to claim 10, wherein in the (D), the heating operation is jointly feeding the vapor chamber, the thermal conductive part, the at least two ring parts, the solder and the positioning fixture into a heating oven.

* * * * *